US006354520B1

(12) United States Patent
Yalcin

(10) Patent No.: US 6,354,520 B1
(45) Date of Patent: Mar. 12, 2002

(54) FUEL INJECTION VALVE FOR INTERNAL COMBUSTION ENGINES

(75) Inventor: Hakan Yalcin, Regensburg (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/674,690

(22) PCT Filed: May 5, 1999

(86) PCT No.: PCT/DE99/01358

§ 371 Date: Jan. 22, 2001

§ 102(e) Date: Jan. 22, 2001

(87) PCT Pub. No.: WO99/57433

PCT Pub. Date: Nov. 11, 1999

(30) Foreign Application Priority Data

May 7, 1998 (DE) ..... 198 20 455

(51) Int. Cl.[7] ..... F02M 61/10; F02M 51/00; B05B 1/30

(52) U.S. Cl. ..... 239/533.11; 239/585.4; 239/585.5

(58) Field of Search ..... 239/533.12, 533.1, 239/533.2, 533.3, 533.4–533.11, 584, 585.1–586, 900; 137/509

(56) References Cited

U.S. PATENT DOCUMENTS

| | | | | | |
|---|---|---|---|---|---|
| 3,531,052 | A | * | 9/1970 | Berlyn | 239/533.12 |
| 4,153,205 | A | * | 5/1979 | Parrish, Jr. | 239/533.9 |
| 5,522,550 | A | * | 6/1996 | Potz et al. | 239/533.9 |
| 5,758,829 | A | * | 6/1998 | Itoh et al. | 239/533.2 |
| 5,979,786 | A | * | 11/1999 | Longman et al. | 239/585.5 |

FOREIGN PATENT DOCUMENTS

| | | |
|---|---|---|
| DE | 295 19 296 U1 | 5/1997 |
| EP | 0 234 314 A2 | 9/1987 |
| EP | 0 363 142 A1 | 4/1990 |
| EP | 0719 936 A1 | 7/1996 |
| GB | 962870 | 7/1964 |
| JP | 58-128464 | 8/1983 |

* cited by examiner

*Primary Examiner*—Lesley D. Morris
*Assistant Examiner*—Davis Hwu

(57) ABSTRACT

Fuel injection valve with a nozzle body (300) which has a central guiding bore (312) and, laterally of the guiding bore (312), a fuel inlet passage (338), both leading into a pressure chamber (334), and between them a dividing wall (346) with a very thin wall section. The nozzle body (300) has at its held end a step whereby the fuel inlet passage (338) runs more steeply into the pressure chamber and thus the wall thickness is greater. Thus a greater pressure resistant strength is achieved in the nozzle body.

5 Claims, 3 Drawing Sheets

FUEL INJECTION VALVE FOR INTERNAL COMBUSTION ENGINES

Figure 1:
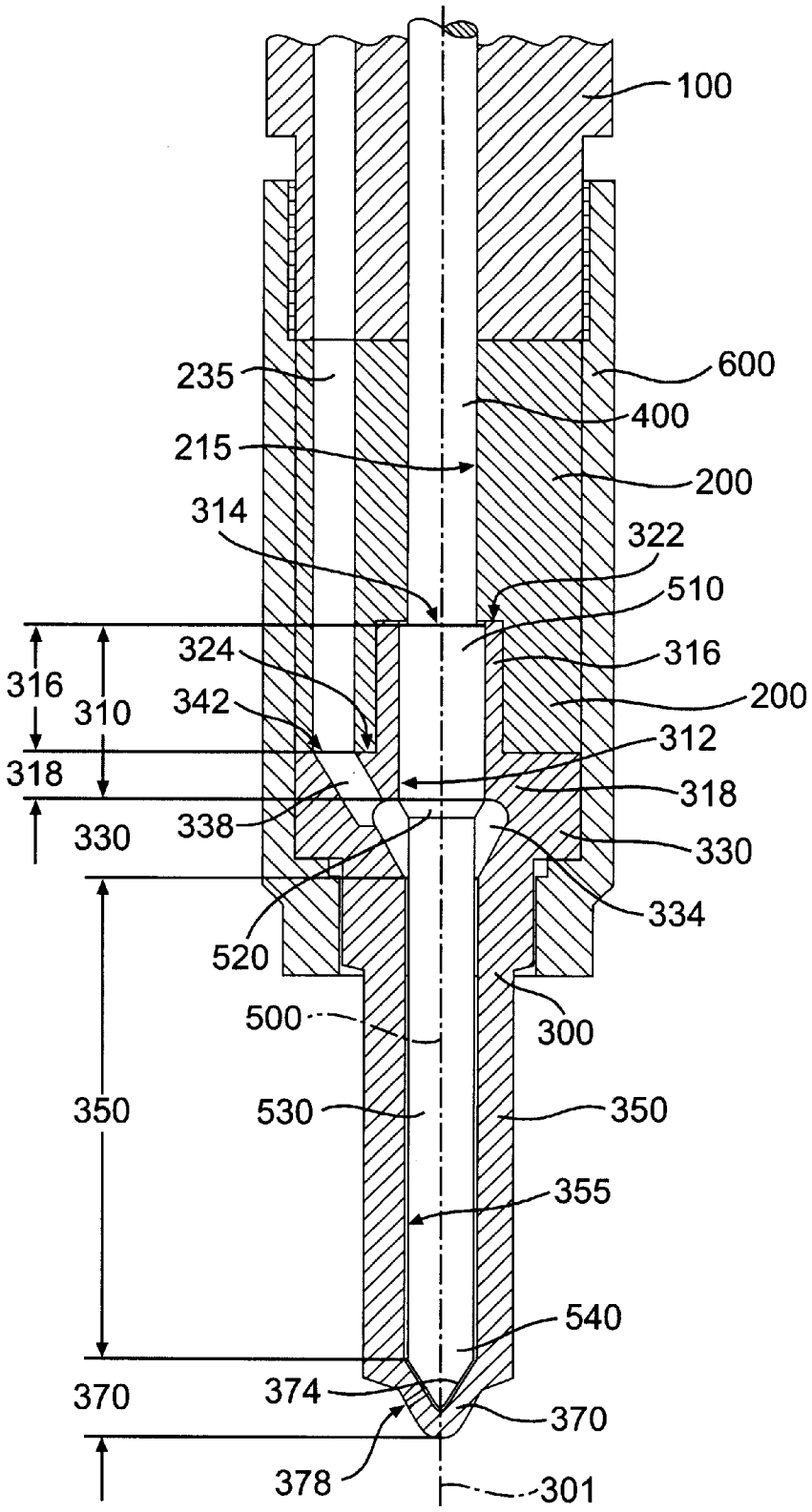

The invention relates to a fuel injection valve according to the preamble of claim 1.

A fuel injection valve of this kind is disclosed in the document EP 0 363 142 A1. In the nozzle body of the known fuel injection valve the dividing wall between the guiding bore and the fuel inlet passage is extremely stressed by the high injection pressure. The fuel inlet passage runs from the face end of the nozzle body, first substantially parallel to the guiding bore, and then it curves toward the pressure chamber, finally entering the pressure chamber.

The invention is addressed to the problem of increasing the strength of the fuel injection valve against pressure.

The problem is solved by the invention through the features of claim 1.

Additional advantageous embodiments and improvements of the invention are stated in the dependent claims.

One advantage of the invention consists in increasing the strength of the nozzle body against pressure. Another advantage lies in the low production cost.

A fuel injection valve, especially for diesel fuel, has to have great strength in order to withstand the high fuel pressure. This strength depends on the minimal achievable thickness of the walls of the components of the fuel injection valve. With the preferred configuration of an offset on the front end of the nozzle body a great wall thickness is achieved in critical areas and consequently a great ability to withstand pressure.

Figure 2:
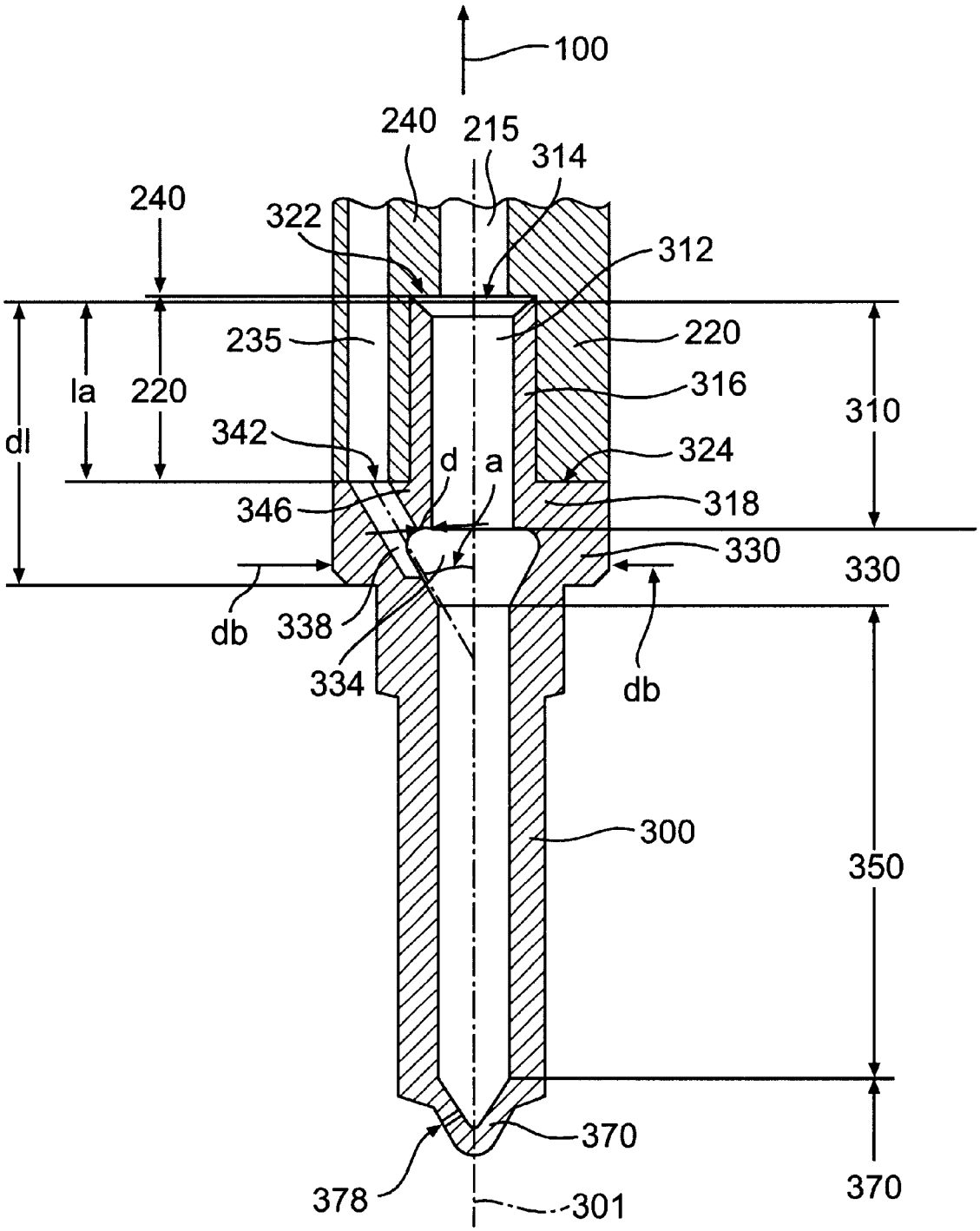
Figure 3:
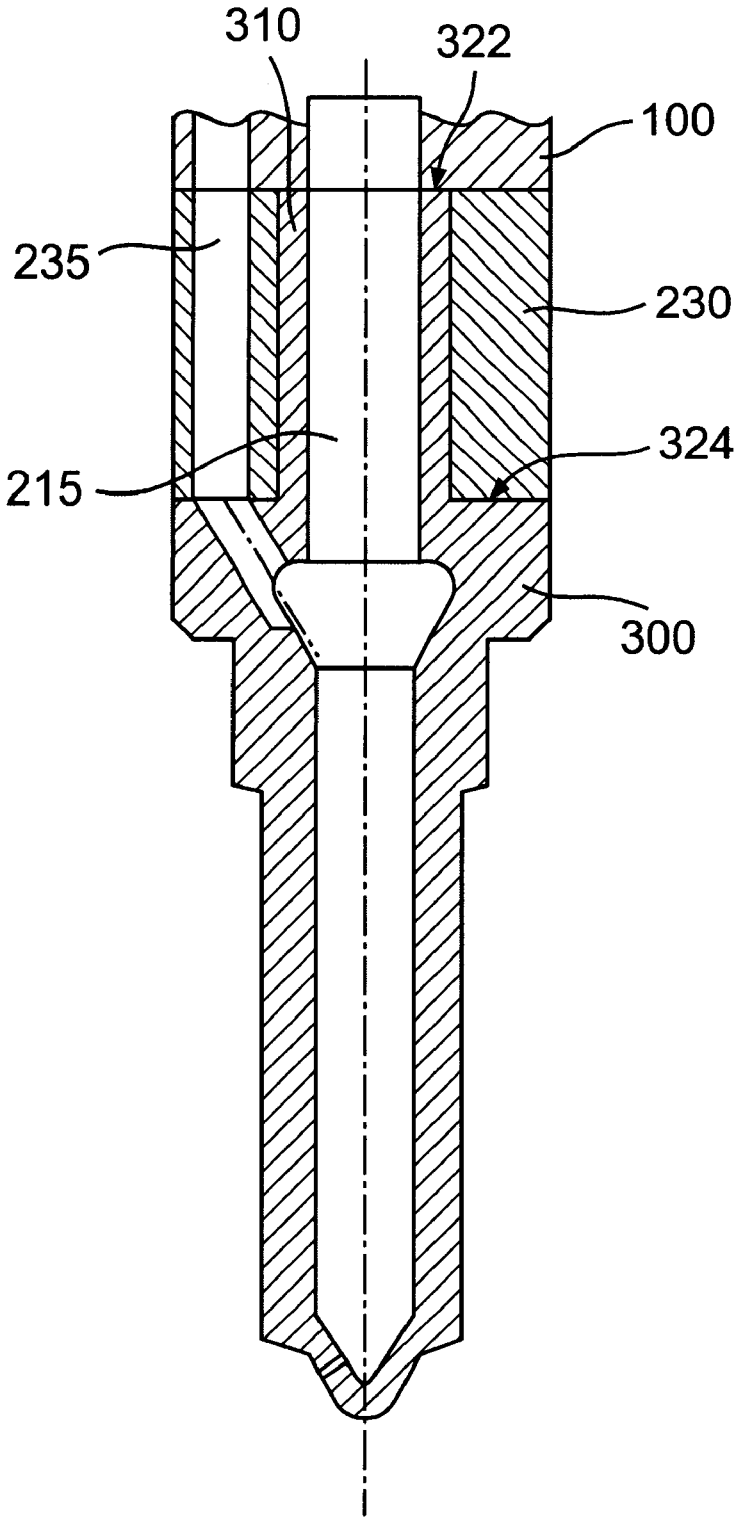

The invention is described below with the aid of the drawing, wherein:

FIG. 1 is a longitudinal section through a portion of the fuel injection valve, FIG. 2 is a longitudinal section of a first embodiment of a nozzle body and a middle piece from FIG. 1, and FIG. 3 is a longitudinal section through a second embodiment of a nozzle body and a middle piece.

Elements of the same design or function are given generally the same reference numbers in FIGS. 1 to 4.

The part of a fuel injection valve represented in FIG. 1 has a nozzle body 300 of rotationally symmetrical basic shape, which is fastened by means of a sleeve nut 600 to a nozzle holder 100, with the interposition of a middle piece 200.

The nozzle body 300 is divided from its end facing the nozzle holder 100 into the following body sections: a guiding portion 310, a pressure chamber portion 330, a shaft portion 350 and a nozzle tip 370 terminating the nozzle body 300.

Beginning at its held end and ending at its nozzle tip 370, the nozzle body 300 has a central nozzle body bore beginning at its held end and ending at its nozzle tip 370, and its diameter and function vary in the body sections of the nozzle body 300. In the nozzle body bore a nozzle needle 500 runs, which is divided toward the nozzle tip 370 into a guiding piston 510, an annular shoulder 520, a piston shaft 530 and a valve tip 540.

The guiding portion 310 has a central guiding bore 312 which serves to guide the piston 510 and has at the end of the guiding portion 310 a bore mouth 314.

The guiding portion 310 is followed by the pressure chamber portion 330 which has a pressure chamber 334. The guiding bore 312 leads into the pressure chamber 334 into which the guiding piston 510 is carried. Preferably, in the pressure chamber 334 the guiding piston 510 merges with the tapering annular shoulder 520 which merges with the piston shaft 530.

A fuel inlet passage 338 is arranged laterally away from the guiding bore 312 and advantageously leads laterally into the pressure chamber 334. The fuel inlet passage 338 has at the end of the guiding portion 310 an inlet opening 342 and is preferably a cylindrical bore which can advantageously be made easily and accurately, e.g., by erosion or drilling. Preferably the axis of the feed inlet passage 338 forms a plane with the longitudinal axis 301 of the nozzle body 300.

Preferably the guiding portion 310 is divided by a step into an upper body section 316 with an annular end face 322 and into a lower body section 318 having an annular shoulder surface 324, the upper body section 316 being arranged at the butt end of the guiding portion 310. The normals of the end face 322 and of the shoulder surface 324 preferably run approximately parallel to the longitudinal axis 301. Thus ease of production is advantageously possible, e.g., by turning and polishing the surfaces. The upper body section 316 has a smaller diameter than the lower body section 318. The end face 322 has the bore mouth 314, and the shoulder surface 324 contains the fuel inlet opening 342.

The shaft portion 350 adjoins the pressure chamber portion 330 which adjoins the pressure chamber 334 and through which the shaft piston 530 runs.

The pressure chamber 334 is configured as a preferably symmetrical ear-shaped cavity which lies between the guiding bore 312 and the shaft bore 355. In the area of the upper portion of the ear the wall of the guiding bore 312 forms with the wall of pressure chamber 334 an angle which is preferably around 90E. In the area of the lower portion of the ear the pressure chamber 334 tapers together, and the wall of the pressure chamber 334 merges with the wall of the shaft portion 350 at a low angle.

The shaft portion 350 is adjoined by a tapered nozzle tip 370 which has an interior valve seat 374 to receive the valve tip 540. The nozzle tip 370 has at least one spray hole 378 through which the fuel is sprayed into the combustion chamber of the internal combustion engine. The axial movement of the valve tip 540 controls the entry of fuel into the combustion chamber, while in the state of rest the valve tip 540 covers the spray holes 378 and interrupts the flow of fuel to the spray holes 378. The fuel is carried in the nozzle body 300 from the fuel inlet passage 338 through the pressure chamber 334, the shaft bore 355, and the valve seat 374 to the spray holes 378.

The exterior of the nozzle body 300 preferably has steps at the level of the pressure chamber 334 and at the level of the shaft portion 350, the diameter of the nozzle body 300 decreasing toward the nozzle tip 370.

The middle piece 200 is of hollow cylindrical shape and has a central piston bore 215 for guiding a piston 400, and a fuel supply passage 235 disposed laterally, preferably approximately parallel to the piston bore 215.

The middle piece 200 limits the stroke of the nozzle needle 500, since the piston bore 215 has a smaller diameter than the guiding piston 510 of the nozzle needle 500.

The piston 400 transfers to the nozzle needle the axial movement produced by a control valve or an actor. The nozzle needle 500 applies to piston 400 an axial thrust in the direction of the piston 400, which is produced by the fuel pressure on the annular shoulder 520 and on the effective annular surface of the valve tip 540.

For clarity, some of the reference numbers in FIG. 1 are used likewise in FIG. 2.

FIG. 2 shows details of the fuel injection valve of FIG. 1 with the nozzle body 300 and the middle piece 200. The fuel inlet passage 338 is preferably a cylindrical bore which can advantageously be made easily and accurately.

The section between the step at the level of the pressure chamber 334 and the end surface 322 of the guiding portion 310 is the barrel area with the barrel length d1 and the barrel diameter db at the level of the pressure chamber 334.

The axial difference in length between the end face 322 and the shoulder surface 324 is the step length 1*a*.

Between the fuel inlet passage 338 and the feed bore 312 is a wall 346. Where the fuel inlet passage 338 and the guiding bore 312 lead into the pressure chamber 334 the wall 346 has a minimum thickness d. A great wall thickness d advantageously gives the nozzle body 300 great strength against pressure. The fuel inlet passage 338 forms with the guiding bore 312 an angle a. The wall thickness d depends on the angle a, the barrel diameter db, the barrel length d1 and the step length 1*a*.

The shorter the barrel length d1 is at a given position of the step at the level of the pressure chamber 334, the greater is the step length 1*a* and the greater the barrel diameter db is, the greater the angle a can be, which results in a greater wall thickness a.

This relationship applies also to nozzle bodies in embodiments which differ from those described in the examples given.

An embodiment of the nozzle body 300 from FIG. 2 has a barrel diameter db of about 14.3 mm and a barrel length d1 of about 15 mm. Depending on the step length 1*a*, the angle a ranges from 10E to 45E. In a preferred embodiment, an angle of about 28E is used, for example, in the case of a step length of 9 mm.

Other embodiments with different barrel diameters db, barrel lengths d1 and step lengths 1*a* have other corresponding ranges of the angle a. Preferably, angle a ranges from 10E to 45E.

The middle piece 200 is divided axially on its inner side facing the piston bore 215 into a hollow cylindrical fuel delivery portion 220 and a hollow cylindrical piston portion 240, the piston portion 240 having a smaller inside diameter than the fuel delivery portion 220. The piston portion 240 is located closer to the nozzle holder 100 than the fuel delivery portion 220.

The step in the middle piece 200 is flush with the step of the guiding portion 310 situated at the end of the nozzle body 300. The fuel inlet passage 338 of the nozzle body 300 connects to the fuel supply passage 235 of the middle piece 200. The shoulder surface 324 of the nozzle body 300 lies flat against the end face of the middle piece 200. The strong force exerted between the nozzle body 300 and middle piece 200 produces a connection highly resistant to pressure.

In another embodiment, the normals of the end face 322, the shoulder surface 324 and the end face of the middle piece 200 are at an angle to the longitudinal axis 301.

The pressure-resisting strength can advantageously be further increased if the edges in the area of the least wall thickness d are additionally rounded over, e.g., by electrochemical rounding.

FIG. 3 shows another embodiment of the nozzle body 300 with the middle piece 200. Unlike the embodiment in FIG. 2 the middle piece 200 is in the form of a hollow cylindrical fuel supply ring 230 without an inner step. The fuel supply passage 235 is disposed in the periphery of the fuel supply ring 230. The fuel supply ring 230 surrounds preferably entirely the upper section 316 of the feed portion 310. The one end of the fuel supply ring 230 abuts the shoulder surface 324 of the feed portion 310. The fuel supply ring 230 and the end face 322 abut against the nozzle holder 100. The fuel inlet passage 338 of the nozzle body 300 adjoins the fuel supply passage 235 in the fuel supply ring 230.

What is claimed is:

1. Fuel injection valve with a nozzle body which has a guiding portion at a held end, with a central guiding bore which has a bore mouth at the held end of the guiding portion, a pressure chamber portion which adjoins the guiding portion and has a pressure chamber into which the guiding bore leads, and a fuel inlet passage which is disposed laterally of the guiding bore, the fuel inlet passage having at the end of the guiding portion a fuel delivery orifice, characterized in that, the guiding portion is graded by a step into an upper body section with an end face and a lower body section with a shoulder surface, that the lower body section is disposed closer to the pressure chamber portion than the upper body section, that the upper body section has a smaller diameter than the lower body section, and that the fuel delivery orifice is situated in the shoulder surface, and the bore mouth in the end face.

2. Fuel injection valve according to claim 1, characterized in that the fuel inlet passage of the nozzle body is in the form of a cylindrical bore.

3. Fuel injection valve according to claim 1, characterized in that the angle which the fuel inlet passage forms with the guiding bore ranges from 10E to 45E.

4. Fuel injection valve according to claim 1, characterized in that a middle piece is configured as a hollow cylindrical fuel supply ring, and that a fuel supply passage is situated in the periphery of the fuel supply ring.

5. Fuel injection valve with a nozzle body which has a guiding portion at a held end, with a central guiding bore which has a bore mouth at the held end of the guiding portion, a pressure chamber portion which adjoins the guiding portion and has a pressure chamber into which the guiding bore leads, and a fuel inlet passage which is disposed laterally of the guiding bore, the fuel inlet passage having at the end of the guiding portion a fuel delivery orifice, characterized in that, the guiding portion is graded by a step into an upper body section with an end face and a lower body section with a shoulder surface, that the lower body section is disposed closer to the pressure chamber portion than the upper body section, that the upper body section has a smaller diameter than the lower body section, that the fuel delivery orifice is situated in the shoulder surface, and the bore mouth in the end face, between the nozzle body and a nozzle holder body a hollow cylindrical middle piece is disposed, which has a central piston bore and a fuel supply passage disposed laterally of the piston bore, that the middle piece is divided on its end facing the piston bore by a step into a hollow cylindrical fuel delivery portion and into a hollow cylindrical piston portion, that the piston portion is arranged closer to the nozzle holder body than the fuel delivery portion, that the piston portion has a smaller inside diameter than the fuel delivery portion, that the fuel delivery passage is provided in the periphery of the fuel delivery portion and in the periphery of the piston portion.

* * * * *